United States Patent [19]

Satoh et al.

[11] Patent Number: 4,576,656

[45] Date of Patent: Mar. 18, 1986

[54] METHOD OF PRODUCING COLD ROLLED STEEL SHEETS FOR DEEP DRAWING

[75] Inventors: Susumu Satoh; Takashi Obara; Minoru Nishida, all of Chiba, Japan

[73] Assignee: Kawasaki Steel Corporation, Kobe, Japan

[21] Appl. No.: 768,927

[22] PCT Filed: Oct. 7, 1983

[86] PCT No.: PCT/JP83/00334

§ 371 Date: Mar. 15, 1984

§ 102(e) Date: Mar. 15, 1984

[87] PCT Pub. No.: WO84/01585

PCT Pub. Date: Apr. 26, 1984

Related U.S. Application Data

[63] Continuation of Ser. No. 596,451, Mar. 15, 1984, abandoned.

[30] Foreign Application Priority Data

Oct. 8, 1982 [JP] Japan ..... 57-177046

[51] Int. Cl.[4] ..... C21D 9/48

[52] U.S. Cl. ..... 148/12 C

[58] Field of Search ..... 148/12 C, 12 D, 12 F

[56] References Cited

U.S. PATENT DOCUMENTS

| | | | |
|---|---|---|---|
| 3,716,420 | 2/1973 | Matsudo et al. | 148/12 C |
| 3,879,232 | 4/1975 | Gondo et al. | 148/12 C |
| 3,897,280 | 7/1975 | Gondo et al. | 148/12 C |

FOREIGN PATENT DOCUMENTS

| | | | |
|---|---|---|---|
| 2603097 | 7/1976 | Fed. Rep. of Germany | 75/123 M |
| 137021 | 11/1978 | Japan | 148/12 C |
| 13123 | 1/1982 | Japan | 148/12 C |
| 63660 | 4/1982 | Japan | 75/123 M |
| WO82/01893 | 6/1982 | PCT Int'l Appl. | 148/12 C |

*Primary Examiner*—Wayland Stallard

*Attorney, Agent, or Firm*—Balogh, Osann, Kramer, Dvorak, Genova & Traub

[57] ABSTRACT

The present invention relates to a method of producing a cold rolled steel sheet for deep drawing. In order to improve the deep drawability (r-value), ductility (yield strength and elongation El) and the like of cold rolled sheet of ultra-low carbon aluminum killed steel, the chemical composition (% by weight) of the steel is adjusted such that the steel contains C: ≦0.015%, Mn: ≦0.4%, P: ≦0.03%, sol. Al: 0.005–0.100%, N: ≦0.010%, Ti (exclusive of Ti present in the form of oxide): in an amount satisfying a formula of $$-0.020\% \leqq M\left\{=\mathrm{Ti}-\left(\frac{48}{32}\mathrm{S}+\frac{48}{14}\mathrm{N}\right)\right\}<0.004\%;$$

the hot rolling of the steel slab is effected at a soaking temperature lower than 1,100° C. and at a finishing temperature of 600°–780° C. As illustrated in the drawings, a low temperature rolling can be carried out, and the resulting cold rolled steel sheet is excellent in the deep drawability and ductility and further excellent in the treatable property of the surface and in the surface property. Therefore, the cold rolled steel sheet is particularly suitable for the production of automotive exterior plate.

3 Claims, 2 Drawing Figures

METHOD OF PRODUCING COLD ROLLED STEEL SHEETS FOR DEEP DRAWING

This application is a continuation of application Ser. No. 596,451, filed Mar. 15, 1984, and now abandoned.

TECHNICAL FIELD

The present invention relates to a method of producing cold rolled steel sheets used for automotive exterior plate and the like and adapted for deep drawing.

BACKGROUND ART

Cold rolled steel sheets used for the production of shaped articles through deep drawing, such as cold rolled steel sheets for deep drawing and the like, are required to be low in the yield strength (YS) and high in the elongation (El), that is, to be excellent in the ductility, and further to have a high Lankford value (r-value) as important mechanical properties. Moreover, shaped articles produced through deep drawing are often used in the outer surface of mechanical products, such as automotive exterior plate and the like, and therefore it is an important property for the cold rolled steel sheet to have an excellent surface property.

Cold rolled steel sheets for deep drawing have hitherto been produced from a low-carbon aluminum killed steel through a box annealing. However, recently a continuous annealing method is widely used for the production of the cold rolled steel sheets for deep drawing from the low-carbon aluminum killed steel in view of the improvement of productivity and the energy saving. However, the use of commonly used low-carbon aluminum killed steel as a starting material can not give satisfactorily excellent mechanical properties to the resulting cold rolled steel sheets for deep drawing. Accordingly, it was proposed to use ultra-low carbon steel having a C content of as low as 0.020% or less as a starting material for the production of cold rolled steel sheet for deep drawing. However, it was difficult to secure, in the conventional method, satisfactorily high r-value and ductility enough to bear the deep drawing even in the use of such ultra-low carbon steel.

Under these circumferences, there have been proposed various methods, wherein carbide- and nitride-forming elements of Nb, Ti, Zr and the like are added to ultra-low carbon steel. Among the prior arts disclosing these methods, Japanese Patent Application Publication No. 18,066/69 and Japanese Patent Laid-open Specification No. 137,021/78 disclose cold rolled steel sheets containing Ti and having deep drawability, and methods of producing the steel sheets.

However, in these methods, it is necessary to carry out a hot rolling at a high finishing temperature, and a high temperature heating of slab and a high temperature hot rolling must be carried out. However, the high temperature heating of slab has such drawbacks that cost for heating energy is high, yield is low due to the oxidation of slab surface, quality of the resulting cold rolled steel sheet is poor due to the increase of internally oxidized product, and troubles occur during the cold rolling. While, the high temperature hot rolling is apt to cause breakage and other troubles of roll and to deteriorate the quality of the surface of the resulting cold rolled steel sheet.

Further, Japanese Patent Laid-open Specification No. 13,123/82 discloses a method of producing a cold rolled steel sheet for deep drawing from a steel containing C: 0.002–0.05% and Ti: 0.070–0.210% through a low-temperature hot rolling. However, in this method, a large amount of Ti is used, and therefore the resulting cold rolled steel sheet is very expensive, and further the cold rolled steel sheet is poor in the surface property and in the treatable property of surface due to the increase of Ti series inclusions.

The object of the present invention is to provide a method of producing cold rolled steel sheets adapted for deep drawing and having excellent ductility and surface property from a Ti-containing steel through a low-temperature hot rolling.

DISCLOSURE OF THE INVENTION

The inventors have made various basic experiments and ascertained that, when an ultra-low carbon steel having an M-value within a specifically limited range, which M-value is defined by the formula $$M = \mathrm{Ti} - \left(\frac{48}{32}\mathrm{S} + \frac{48}{14}\mathrm{N}\right)$$

with respect to the amount of Ti present in the steel in the form other than oxide, is soaked at a temperature lower than the ordinary soaking temperature, a cold rolled steel sheet having excellent deep drawability can be obtained. This fact will be explained hereinafter.

In a basic experiment, molten steels of ultra-low carbon steels containing carbon in two different levels and having a widely ranging M-value $$\left(M = \mathrm{Ti} - \left(\frac{48}{32}\mathrm{S} + \frac{48}{14}\mathrm{N}\right)\right)$$

as shown in the following Table 1 were produced through a converter and an RH degassing apparatus. In the steels, substantially all of the oxide was aluminum series oxide, and therefore total amount of Ti was used as the Ti content of the steels in the calculation of the M-value.

TABLE 1

| | Chemical composition of steels used in the basic experiment (% by weight) | | | | | | | | | |
|---|---|---|---|---|---|---|---|---|---|---|
| | C | Si | Mn | P | S | N | O | Al | Ti | M |
| A | ~ 0.004 | ~ 0.01 | ~ 0.15 | ~ 0.01 | 0.003 ~ 0.020 | 0.0013 ~ 0.0086 | 0.002 ~ 0.004 | 0.03 ~ 0.05 | 0.008 ~ 0.065 | −0.034 ~ 0.030 |
| B | ~ 0.009 | ~ 0.01 | ~ 0.15 | ~ 0.01 | 0.004 ~ 0.021 | 0.0015 ~ 0.0072 | 0.002 ~ 0.005 | 0.02 ~ 0.06 | 0.012 ~ 0.055 | −0.038 ~ 0.027 |

Figure 1:
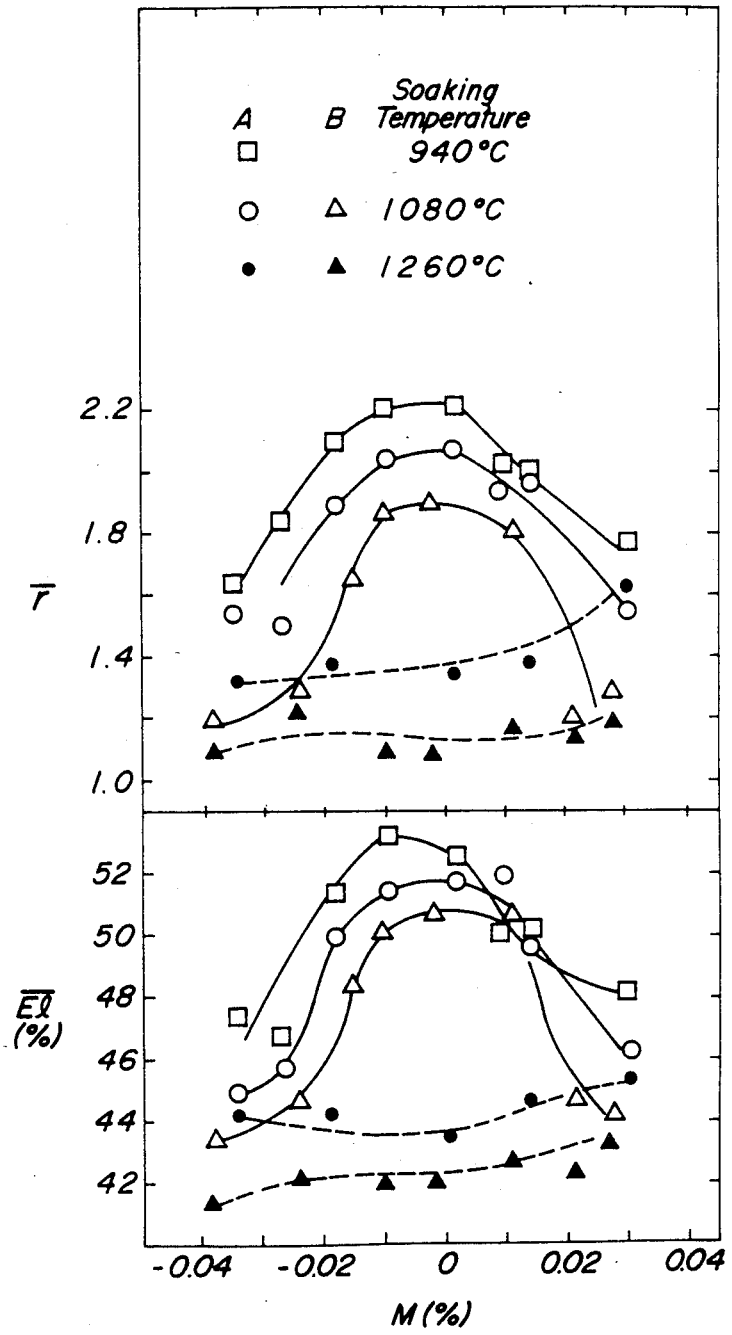
FIG. 1 is a graph illustrating the influences of the M-value and soaking temperature of a steel slab upon the properties of the resulting cold rolled steel sheet.

Each of molten steels shown in Table 1 was cast into a steel slab by means of a continuous casting apparatus, and the slab was cooled to about room temperature. The slab was soaked at 1,260° C., which is a commonly used soaking temperature, or at 1,080° C. or 940° C., which is lower than the commonly used soaking temperature, and then subjected to hot rolling. The hot rolling was carried out by means of a hot strip mill comprising 4 stands of roughing mills and 7 stands of finishing mills to produce a hot rolled steel sheet having a thickness of 3.2 mm. The finishing temperature in the hot rolling was about 730° C., and the coiling temperature was about 580° C. in all steel samples. To hot rolled steel sheet was pickled, cold rolled (final gauge: 0.7 mm), and then subjected to a continuous annealing at a constant temperature of 810° C. for 30 seconds and to temper-rolling at a reduction rate of 0.5%. The elongation El and r-value of the above treated cold rolled steel sheet were plotted in FIG. 1.

It can be seen from Table 1 that (1) the properties of the resulting cold rolled steel sheet can be determined by the M-value independently of C content, and when the M-value is within the range of from −0.020% to less than 0.004%, a cold rolled steel sheet having excellent deep drawability can be obtained; and (2) when the soaking temperature of slab is high, the properties of cold rolled steel sheet are very poor independently of the M-value.

The deep drawability of a Ti-containing ultra-low carbon steel has hitherto been determined by the ratio of the Ti content to the C content. The reason has hitherto been metallographically explained as follows. C is bonded with Ti to form a carbide TiC and to decrease the amount of free state C or solute C, whereby a (111) recrystallization texture, which acts favorably on the improvement of deep drawability, is developed in a large amount during the recrystallization annealing. However, the inventors have found out a novel fact as described above that, when a Ti-containing ultra-low carbon steel slab is soaked at low temperature and then hot rolled, the deep drawability of the resulting cold rolled steel sheet is not determined by the ratio of the Ti content to the C content, but is determined by the ratio of the Ti content to the (S+N) content.

Based on the above described basic experiments, the inventors have repeated experiments by changing hot rolling condition and other conditions with respect to steels having a chemical composition different from that shown in Table 1, and ascertained that a cold rolled steel sheet having excellent deep drawability can be obtained by limiting the chemical composition of the steel and the production condition of the cold rolled steel sheet.

The present invention is based on the above described discovery, and provides a method of producing a cold rolled steel sheet for deep drawing, comprising soaking at a temperature lower than 1,100° C. a steel slab having a composition consisting of, in % by weight, not more than 0.015% of C, not more than 0.40% of Mn, not more than 0.03% of P, 0.005–0.100% of sol. Al, not more than 0.010% of N, Ti in an amount within the range satisfying the following formula $$-0.020\% \leqq \mathrm{Ti} - \left(\frac{48}{32}\mathrm{S} + \frac{48}{14}\mathrm{N}\right) < 0.004\%$$

provided that the Ti in the formula does not include Ti present in the slab in the form of oxide, and the remainder being Fe and incidental impurities; finishing a hot rolling of the soaked slab at a temperature of 600°–780° C.; cold rolling the hot rolled sheet; and annealing the cold rolled sheet.

An explanation will be made with respect to the reason for the limitation of the chemical composition of the steel to be used in the present invention.

When the C content is high, the resulting cold rolled steel sheet is high in the yield strength and is poor in the elongation El, and further is unsatisfactory in the r-value. Accordingly, the C content is limited to not higher than 0.015%.

P acts to embrittle a cold rolled steel sheet, particularly causes troubles, such as crack in the secondary working and the like, after deep drawing. Therefore, the P content is limited to not higher than 0.03%.

Al is effective for decreasing the oxygen content in a steel, and must be added to a steel sheet in an amount of at least 0.005% in an acid-soluble form. However, when the amount of sol. Al exceeds 0.100%, the surface property of the resulting cold rolled steel sheet is poor. Therefore, the content of sol. Al is limited to not higher than 0.100%.

When the N content is higher than 0.010%, satisfactorily high ductility and ageing resistance can not be obtained in the resulting cold rolled steel sheet. Therefore, the N content is limited to not higher than 0.010%.

Ti is an important element in the present invention. As already explained in the above described basic experiments, it is necessary to add Ti to a starting steel such that the M-value $$\left(= \mathrm{Ti} - \left(\frac{48}{32}\mathrm{S} + \frac{48}{14}\mathrm{N}\right)\right)$$

is within the range of from −0.020% to less than 0.004%, preferably from −0.015% to less than 0.004%. However, Ti may be bonded with oxygen depending upon the production condition of the starting steel. Accordingly, in the definition formula for the M-value, the amount of Ti present in the steel in the form of oxide is excluded.

Then, an explanation will be made with respect to the production steps of a cold rolled steel sheet according to the present invention. The steel making method is not particularly limited. However, in order to decrease the C content to not higher than 0.015%, a combination system of a converter and a degassing apparatus is effective. A steel slab can be produced by an optional method. However, the continuous casting method or an ingot making-slabbing method is advantageously used.

In the present invention, a step for producing a hot rolled steel strip from a steel slab is particularly important. When a steel slab after cooled to about room temperature is soaked or a steel slab still having a high temperature is directly soaked, a low temperature soaking is necessary, wherein the steel slab is soaked at an average temperature of less than 1,100° C., preferably less than 1,000° C., as clearly understood from the basic experiments illustrated in FIG. 1.

Figure 2:
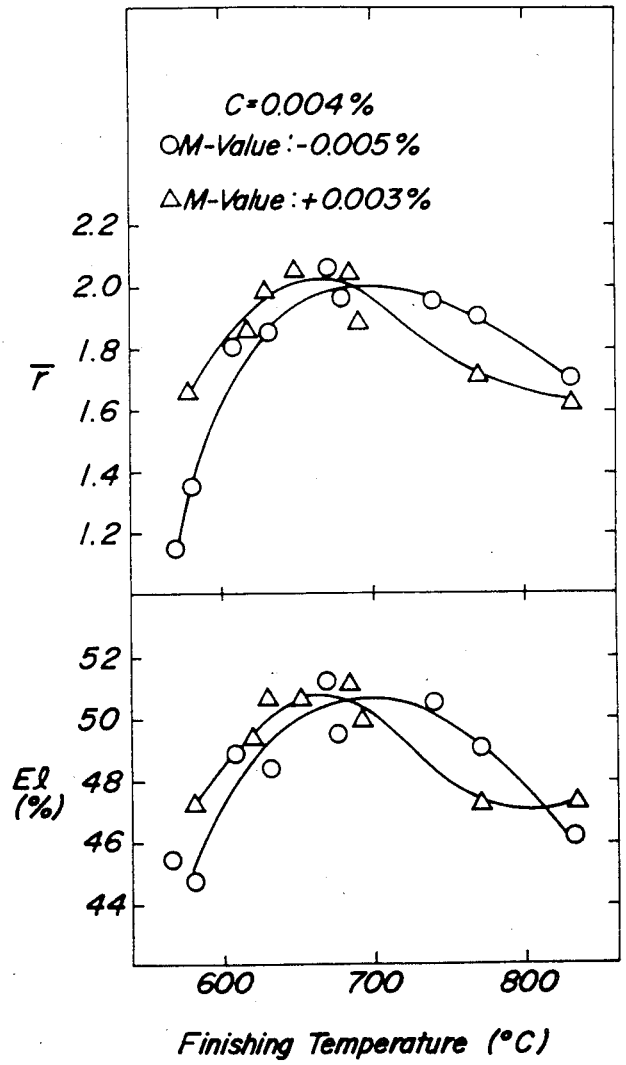
FIG. 2 is a graph illustrating the influence of the finishing temperature of hot rolling of a steel slab upon the properties of the resulting cold rolled steel sheet.

Then, in the hot rolling, the hot rolling finishing temperature must be within the range of 600°–780° C., and is preferably within the range from 600° C. to less than 700° C., in order to obtain excellent deep drawability as illustrated in FIG. 2.

The coiling temperature after hot rolling is not particularly limited. However, in order to improve the pickling efficiency, the coiling temperature is preferably not higher than 600° C. The cold rolling step is not particularly limited as well. However, in order to obtain high r-value and to obtain low planar anisotropicity, the cold rolling reduction rate is preferably 50–95%.

The final annealing can be carried out by either a box annealing by means of a bell furnace or a continuous annealing through a rapid heating-short time heating cycle. However, the continuous annealing is superior to the box annealing in view of the productivity. The annealing temperature is preferably within the range of 650°–900° C. As to the heat cycle in the continuous annealing, the cooling rate after constant-temperature heating or the addition of overageing treatment and the overageing condition have not an essential influence upon the properties of the resulting cold rolled steel sheet. However, a gradual cooling at a rate of 10° C. or less, or a overageing treatment at a temperature of about 350° C. is effective for the improvement of the properties, particularly the ductility, of the product.

After completion of the annealing, the cold rolled steel sheet may be subjected to a temper-rolling at a reduction rate of not higher than 1.5% in order to correct its shape and for other purposes.

BEST MODE OF CARRYING OUT THE INVENTION

Molten steels having a chemical composition shown in the following Table 2 were produced. In the steel shown in Table 2, Steels 1–4 are those of the present invention, and Steels 5–7 are comparative steels. Each of the molten steels was made into a slab through a converter-degassing-continuous casting method. The slab was cooled to room temperature and then heated to a soaking temperature shown in Table 2 in a heating furnace. However, only in Steel 2, the cooling of the slab was stopped at about 500° C., and the slab was charged into the heating furnace and heated to a soaking temperature shown in Table 2.

The soaked slab was hot rolled into a hot rolled sheet of 3.2–3.8 mm thickness under a hot rolling condition shown in Table 2, pickled, and then cold rolled into a cold rolled sheet having a final gauge of 0.7–0.8 mm thickness. The cold rolled sheet of Steel 4 was subjected to a continuous annealing (constant temperature: 800° C.) and successively to a hot-dip zinc plating in a continuous hot-dip zinc plating line. Cold rolled sheets other than Steel 4 were annealed at a constant temperature of 820° C. in a continuous annealing line. After the annealing, Steels 3 and 5 were rapidly cooled at a rate of not less than 40° C./sec, and subjected to an overageing treatment at 350°–400° C. for 150 seconds. All the above treated steel sheets were subjected to a temper-rolling at a reduction rate of 0.3–0.8%, and the surface properties and mechanical properties of the resulting products were tested. The obtained results are shown in the following Table 3.

It can be seen from Table 3 that the cold rolled steel sheet according to the present invention is high in the ductility and r-value and has excellent deep drawability. Particularly, the hot-dip zinc plated steel sheet (Steel 4) is excellent in the throwing power and adhesion, and the surface properties of the all resulting cold rolled steel sheets are excellent.

TABLE 2

Chemical composition of steels and hot rolling condition

| | Steel | Chemical composition (wt %) C | Si | Mn | P | S | N | O | Al | Ti | M[1] | Hot rolling condition: Soaking temperature (°C.) | Finishing temperature (°C.) | Coiling temperature (°C.) |
|---|---|---|---|---|---|---|---|---|---|---|---|---|---|---|
| Steel of this invention | 1 | 0.004 | 0.01 | 0.12 | 0.01 | 0.008 | 0.0030 | 0.0028 | 0.029 | 0.024 | 0.002 | 900 | 670 | 530 |
| | 2 | 0.002 | 0.02 | 0.15 | 0.01 | 0.012 | 0.0026 | 0.0040 | 0.060 | 0.020 | −0.007 | 1,080 | 760 | 450 |
| | 3 | 0.013 | 0.01 | 0.05 | 0.01 | 0.003 | 0.0044 | 0.0022 | 0.031 | 0.010 | −0.010 | 970 | 660 | 600 |
| | 4 | 0.001 | 0.01 | 0.18 | 0.02 | 0.012 | 0.0022 | 0.0025 | 0.051 | 0.021 | −0.004 | 880 | 630 | 500 |
| Comparative steel | 5 | 0.017 | 0.02 | 0.15 | 0.01 | 0.011 | 0.0024 | 0.0022 | 0.040 | 0.037 | 0.012 | 1,100 | 760 | 570 |
| | 6 | 0.006 | 0.01 | 0.20 | 0.01 | 0.012 | 0.0032 | 0.0035 | 0.031 | 0.004 | −0.025 | 1,040 | 740 | 560 |
| | 7 | 0.005 | 0.02 | 0.13 | 0.01 | 0.010 | 0.0045 | 0.0030 | 0.011 | 0.057 | 0.027 | 1,050 | 740 | 600 |

[1] $M = Ti - \left(\frac{48}{32}S + \frac{48}{14}N\right)$

TABLE 3

Mechanical properties of cold rolled steel sheets

| | Steel | $\overline{YS}$ (kg/mm²) | $\overline{TS}$ (kg/mm²) | $\overline{El}$ (%) | $\bar{r}$ |
|---|---|---|---|---|---|
| Steel of this invention | 1 | 15 | 29 | 51 | 1.9 |
| | 2 | 14 | 29 | 52 | 2.1 |
| | 3 | 18 | 32 | 48 | 1.8 |
| | 4 | 13 | 28 | 53 | 2.1 |
| Comparative steel | 5 | 20 | 34 | 43 | 1.4 |
| | 6 | 18 | 30 | 45 | 1.4 |
| | 7 | 19 | 31 | 44 | 1.5 |

(Note)
Test specimen: JIS No. 5
Pulling direction:
Directions at inclination angles of 0°, 45° and 90° with respect to the rolling direction. The property is a mean value of the values in these directions.

INDUSTRIAL APPLICABILITY

As described above, according to the present invention, a cold rolled steel sheet having high r-value and deep drawability and further having low yield strength and high elongation, that is, having excellent ductility, can be produced. Therefore, the present invention can be applied to the production of a cold rolled steel sheet which will be formed into mechanical parts through deep drawing. Particularly, the resulting cold rold steel sheet has high throwing power in the plating, and is excellent in the adhesion and surface property. Therefore, the present invention is suitable for the production of a cold rolled steel sheet to be used for the production of automotive exterior plate through deep drawing.

We claim:

1. A method of producing cold rolled steel sheets for deep drawing, comprising soaking at a temperature lower than 1,100° C. a steel slab having a composition consisting of, in % by weight, not more than 0.015% of C, not more than 0.40% of Mn, not more than 0.03% of P, 0.005–0.100% of sol. Al, not more than 0.010% of N, Ti in an amount within the range satisfying the following formula $$-0.020\% \leqq \mathrm{Ti} - \left(\frac{48}{32}\mathrm{S} + \frac{48}{14}\mathrm{N}\right) < 0.004\%$$

provided that the Ti in the formula does not include Ti present in the slab in the form of oxide, and the remainder being Fe and incidental impurities; finishing a hot rolling of the soaked slab at a temperature of 600°–780° C.; cold rolling the hot rolled sheet; and annealing the cold rolled sheet, so as to produce a cold rolled steel sheet having an elongation higher than 51%, and a r-value higher than 1.6.

2. A method according to claim 1, wherein the steel slab contains Ti in an amount within the range satisfying the following formula $$-0.015\% \leqq \mathrm{Ti} - \left(\frac{48}{32}\mathrm{S} + \frac{48}{14}\mathrm{N}\right) < 0.004\%$$

provided that the Ti in the formula does not include Ti present in the slab in the form of oxide.

3. A method according to claim 2, wherein the steel slab is soaked at a temperature lower than 1,000° C. and the hot rolling is finished at a temperature of not lower than 600° C. and lower than 700° C.

* * * * *